United States Patent [19]

Strobl et al.

[11] Patent Number: 4,953,789

[45] Date of Patent: Sep. 4, 1990

[54] ARRANGEMENT FOR THE METERED SUPPLY OF A FUEL, ESPECIALLY INTO THE COMBUSTION SPACE OF AN INTERNAL COMBUSTION ENGINE

[75] Inventors: Wolfgang Strobl, Eichstaett; Walter Peschka, Sindelfingen; Gottfried Schneider, Stuttgart, all of Fed. Rep. of Germany

[73] Assignee: Bayerische Motoren Werke AG, Fed. Rep. of Germany

[21] Appl. No.: 190,687

[22] PCT Filed: May 13, 1987

[86] PCT No.: PCT/EP87/00247

§ 371 Date: Jan. 22, 1988

§ 102(e) Date: Jan. 22, 1988

[87] PCT Pub. No.: WO87/07336

PCT Pub. Date: Dec. 3, 1987

[30] Foreign Application Priority Data

May 22, 1986 [DE] Fed. Rep. of Germany ..... 3617255

[51] Int. Cl.[5] ..... B05B 15/00

[52] U.S. Cl. ..... 239/132.5; 239/585

[58] Field of Search ..... 239/132.5, 132, 132.3, 239/533.3–533.9, 472, 585, 399.5

[56] References Cited

U.S. PATENT DOCUMENTS

| | | | |
|---|---|---|---|
| 2,183,674 | 12/1939 | Erren | 123/27 GE |
| 3,443,755 | 5/1969 | Bricmont | 239/132.5 |
| 3,451,627 | 6/1969 | Barber | 239/132.5 X |
| 3,458,351 | 6/1969 | Messerschmidt | 239/132.5 X |
| 3,737,100 | 6/1973 | Dreisen | 239/132.5 X |
| 3,802,681 | 4/1974 | Pfiefer | 239/132.5 X |
| 4,081,141 | 3/1978 | Courson et al. | 239/585 X |
| 4,295,452 | 10/1981 | Lembke et al. | 239/533.2 X |
| 4,365,756 | 12/1982 | Fisher | 239/533.2 |
| 4,471,909 | 9/1984 | Perr | 239/132.5 X |
| 4,564,145 | 1/1986 | Takada et al. | 239/585 |
| 4,613,081 | 9/1986 | Bauer | 239/585 |
| 4,700,891 | 10/1987 | Hans et al. | 239/132.5 |
| 4,726,389 | 2/1988 | Minoura et al. | 239/585 X |

FOREIGN PATENT DOCUMENTS

| | | | |
|---|---|---|---|
| 1148426 | 6/1983 | Canada | 239/585 |
| 733319 | 3/1943 | Fed. Rep. of Germany . | |
| 2834844 | 3/1979 | Fed. Rep. of Germany | 239/585 |
| 3113475 | 10/1982 | Fed. Rep. of Germany | 239/533.9 |
| 3342582 | 6/1985 | Fed. Rep. of Germany . | |
| 844383 | 7/1939 | France . | |
| 380441 | 9/1964 | Switzerland . | |
| 27756 | 12/1912 | United Kingdom . | |

OTHER PUBLICATIONS

"Liquid Hydrogen as a Fuel of the Future for Individual Transport," W. Strobl et al., BMW-AG and German Aerospace Research Establishment.

*Primary Examiner*—Andres Kashnikow
*Assistant Examiner*—Kevin P. Weldon
*Attorney, Agent, or Firm*—Evenson, Wands, Edwards, Lenahan & McKeown

[57] ABSTRACT

An arrangement for the metered feed of a fuel, especially in the combustion space of an internal combustion engine, includes a valve guided and actuatable in a valve body via a stem which intermittently controls a discharge opening arranged in the valve body. The stem of the valve is hollow for the formation of a reservoir chamber which enables the arrangement to be used for a cryogenic gaseous fuel. Channels are arranged in the stem and connect the reservoir chamber with an overflow chamber in the valve body which is arranged adjacent the discharge opening. The channels can be swirl channels.

16 Claims, 1 Drawing Sheet

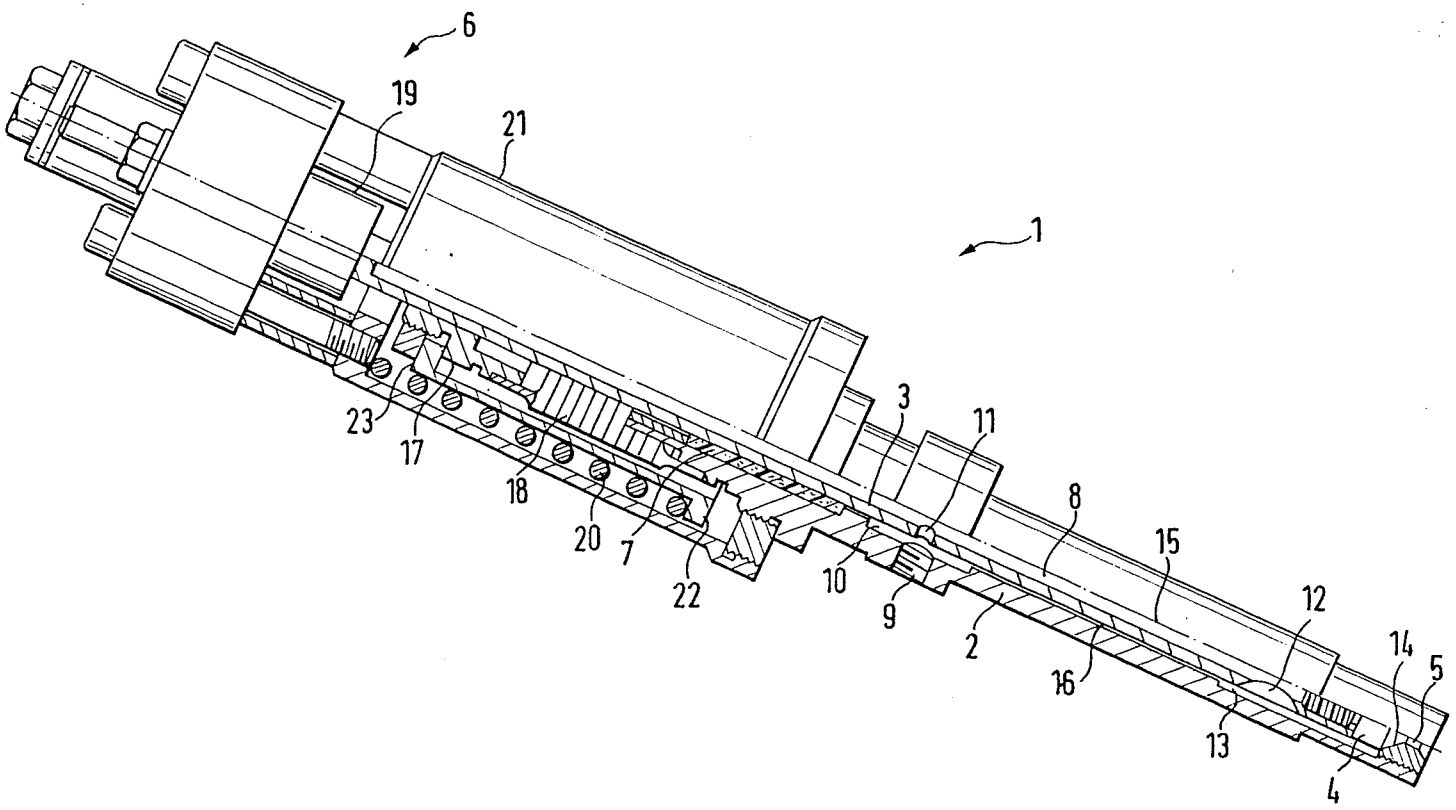
1
2
3
4
5
6
7
8
9
10
11
12
13
14
15
16
17
18
19
20
21
22
23

ARRANGEMENT FOR THE METERED SUPPLY OF A FUEL, ESPECIALLY INTO THE COMBUSTION SPACE OF AN INTERNAL COMBUSTION ENGINE

The invention starts from the DE-OS 34 32 663 according to the preamble of the independent claim.

The known arrangement serves for the injection of a liquid fuel into the combustion space of a diesel engine, whereby a rotation of its own about the jet axis is imposed on the injection jet for the better mixture formation. This rotation of its own, respectively, the swirl of the injection jet, is effected by channels arranged inclined to the valve axis, by way of which the fuel is fed with an opened valve from a chamber formed in the valve body to the discharge opening. In a first embodiment, the channel is arranged helically-like at the outer circumference of a cylindrical collar adjacent the valve cone, whereby the channel is in connection with an annular chamber storing the fuel. The annular chamber is delimited, on the one hand, by the stem of the valve and, on the other, by the bore in the valve body receiving the valve-collar. In a second embodiment, the chamber storing the fuel is constructed as an annular chamber radially spaced from the valve in the valve body, from which the fuel is fed with an opened valve to the discharge opening by way of tangentially arranged channels. A relatively unimpeded heat flow to the fuel in the respective reservoir chamber of the arrangement is true for both embodiments.

The invention is concerned with the task to so construct the arrangement of the aforementioned type of construction for the use of a cryogenic, gaseous fuel, especially hydrogen, that the essential part of the cryogenic fuel stored during operation in the arrangement can absorb little heat.

This task is solved with the characteristic features of the independent patent claim. An interruption of the heat flow from the valve body to the fuel stored in the hollow stem of the valve is achieved by a stem arranged predominantly with clearance in the valve body so that the cryogenic fuel can be fed to the combustion space of the internal combustion engine with essentially unchanged density.

An advantageous further development of the invention by simple means is described in the claim 2. Cryogenic fuel can flow by the means described therein from the inflow chamber by way of the stem clearance with the valve body to the overflow channel adjacent the discharge opening whereby this flow taking place in the by-pass occurs above all with opened valve. This has the advantage that the cryogenic fuel has only a short duration of stay in the by-pass and thus, on the one hand, absorbs little heat and, on the other, additionally cools the hollow stem of the valve from the outside. Claim 3 describes a further construction of the arrangement in which the valve is intermittently controlled by way of the stem by a separate stroke-actuating mechanism. In order to keep small the heat flow favored by the large mass of the actuating mechanism to the fuel supply disposed behind the valve in the hollow stem, the stem according to a partial feature of the claim 6 is constructed hollow, approximately up to the coupling with the stroke-actuating mechanism. With radial fuel feed at about half the length of the stem to the reservoir chamber a cooling cushion is therewith realized in the hollow stem of the valve between the feed and the actuating mechanism. A hermetic seal toward the outside to the surroundings is achieved with the arrangement described in claim 4 for the stem extended beyond the valve body to the coupling with the stroke-actuating mechanism and therewith a slide seal is avoided which is difficult to control with cryogenic fuels. An actuating mechanism is finally described in the claim 5 which in an advantageous manner can be constructed small in diameter and protects the bellows provided for the hermetic seal against damages.

The invention is described by reference to an embodiment illustrated in the drawing in a half-longitudinal cross section.

An arrangement 1 for the metered feed of cryogenic, gaseous hydrogen into the combustion space of a non-illustrated internal combustion engine includes within a valve body 2 a valve 4 guided by way of a stem 3, which intermittently controls a discharge opening 5 arranged in the valve body 2. The intermittent control of the valve 4 is effected by a separate stroke-actuating mechanism 6 which engages at the stem 3 of the valve 4. In an end area opposite the valve 4, the stem 3 is guided within the valve body 2 by a bushing 7. The bushing can be made of Teflon graphite or Teflon bronze in view of the cryogenic fuel.

As can be seen from the figure, the stem 3 is constructed hollow between the valve 4 and the coupling place with the stroke-actuating mechanism 6. The hollow stem 3 serves in the arrangement 1 as reservoir chamber 8 for the cryogenic hydrogen which is to be introduced into the combustion space of the internal combustion engine by way of the discharge opening 5. For the feed of the cryogenic fuel an inflow chamber 10 in communication with a fuel connection 9 is arranged in the valve body 2 adjacent the bushing 7 on the valve side. The inflow chamber 10 is in fuel-conducting connection with the reservoir chamber 8 by way of openings 11 in the stem 3. Furthermore channels 12 closely adjacent the valve 4 are arranged in the stem 3. The channels 12 connect the reservoir chamber 8 with an overflow chamber 13 concentric in the valve body 2 to the stem 3. The overflow chamber 13 adjoins directly the discharge opening 5, respectively, the valve seat 14. For achieving an injection jet having a swirl, the channels 12 are arranged inclined with respect to the valve axis 15 and/or approximately tangential in the circumferential direction of the stem 3. Further, the inflow chamber 10 is in fuel-conducting connection with the overflow chamber 13 by way of a gap 16 formed between stem 3 and valve body 2.

On the side of the bushing 7 opposite from the valve 4, the stem 3 is extended beyond the valve body 2 for the connection with the separate stroke-actuating mechanism 6. As can be further seen from the drawing, the stem 3 is constructed hollow approximately up to the coupling place with the stroke-actuating mechanism 6. Further, a connecting flange 17 axially spaced from the valve body 2 is arranged fuel-tight on the stem 3 in its end area facing the stroke-actuating mechanism 6. For achieving a fuel-tight arrangement, an axially yielding bellows 18 is arranged between the connecting flange 17 and the free end of the valve body 2, which is in fuel-tight connection at both ends with the respective structural part.

The stroke-actuating mechanism 6 includes a stroke drive 19 moving the valve 4 in the opening direction as well by way of the stem 3 as a closing spring 20. The closing spring 20 is arranged in a housing 21 on the one hand connected with the valve body 2 and, on the other, carrying the stroke drive 19, and is supported at one end against the housing 21. At the other end, the closing spring 20 is supported on a radially outwardly directed flange 22 of a hat-shaped bushing 23 arranged at the stem 3 by way of the connecting flange 17. The stroke-actuating mechanism 6 together with the valve body 2 forms by way of the housing 21 a structural unit.

During the operation of the internal combustion engine, the cryogenic hydrogen fed with pressure by way of the fuel connection 9 enters by way of openings 11 into the reservoir space 8 formed in the hollow stem 3. With an opening valve 4, the hydrogen enters with swirl into the overflow chamber 13 from the reservoir chamber 8 by way of the channels 12 and from the overflow chamber 13 by way of the discharge opening 5 into the combustion space of the internal combustion engine. The gap 16 between the stem 3 and the valve body 2 effects, on the one hand, quite generally an interruption of the heat flow to the cryogenic fuel present in the hollow stem 3, respectively, in the reservoir space 8. On the other, the gap 16 effects a fuel transport from the inflow chamber 10 to the overflow chamber 13 with the effect of a large-surface cooling of the stem 3 at its outer surface. The hydrogen flowing from the reservoir chamber 8 by way of the channels 12 and the overflow chamber 13 to the discharge opening 5 exerts a suction effect on the hydrogen present in the gap 16 so that the hydrogen present in the bypass with respect to the reservoir chamber 8 through the gap 16 is rapidly renewed and a good cooling of the stem 3 is effected therewith.

We claim:

1. An arrangement for the metered feeding of a fuel, especially into the combustion space on an internal combustion engine comprising:

a valve body means having a discharge opening at its distal end arranged downstream of a valve seat;

a valve for engaging the valve seat to close the discharge opening and actuated by movement of a hollow stem means guided in the valve body means by guide means, the valve intermittently controlling the opening of the discharge opening by movement of the stem means away from the discharge opening;

a fuel reservoir chamber means, formed in the hollow stem means, which is connected by channels means arranged in the stem means with an overflow chamber upstream and adjacent the valve seat;

a fuel conducting connection which communicates with an inflow chamber adjacent the proximal end of the valve body means;

the valve body means and stem means being sized to form a gap therebetween which connects the inflow chamber to the overflow chamber in a fuel conducting manner at least when the valve is moved to open the discharge opening; and at least one radial opening in the stem means, adjacent the inflow chamber of the fuel-conducting connection for conducting fuel to the fuel reservoir chamber of the stem means.

2. An arrangement according to claim 1, wherein the guide means includes a bushing means.

3. An arrangement according to claim 1, wherein the stem means is extended beyond the valve body means for the connection with a separate stroke-actuating means which together with the valve body means forms a structural unit.

4. An arrangement according to claim 3, further comprising a connecting flange axially spaced from the valve body means which is arranged fuel-tight at the stem means in its end area facing the stroke-actuating means, the connecting flange being in further fuel-tight connection with the valve body means by way of a axially yielding bellows.

5. An arrangement according to claim 4, wherein the stroke-actuating means includes a stroke drive means displacing the valve by way of the stem means in the opening direction and a closing spring, said closing spring being arranged in a housing means which, on the one hand, is operatively connected with the valve body means and on the other supports the stroke drive means, said closing spring acting on a radially outwardly directed flange of a substantially hat-shaped bushing means arranged at the stem means by way of the connecting flange.

6. An arrangement according to claim 5, wherein the stem means is guided in the valve body means by way of a bushing means of Teflon graphite or Teflon bronze and is constructed hollow approximately up to the coupling place with the stroke drive means.

7. Arrangement according to claim 1, wherein the fuel comprises a cryogenic fuel including hydrogen.

8. An arrangement according to claim 7, wherein the stem means is extended beyond the valve body means for the connection with a separate stroke-actuating means which together with the valve body means forms a structural unit.

9. An arrangement according to claim 8, further comprising a connecting flange axially spaced from the valve body means which is arranged fuel-tight at the stem means in it end area facing the stroke-actuating means, the connecting flange being in further fuel-tight connection with the valve body means by way of an axially yielding bellows.

10. An arrangement according to claim 9, wherein the stroke-actuating means includes a stroke drive means displacing the valve by way of the stem means in the opening direction and a closing spring, said closing spring being arranged in a housing means which, on the one hand, is operatively connected with the valve body means and on the other carries the stroke drive means, said closing spring acting on a radially outwardly directed flange of a substantially hat-shaped bushing means arranged at the stem means by way of the connecting flange.

11. An arrangement according to claim 8, wherein the stem means is guided in the valve body means by way of a bushing means of Teflon graphite or Teflon bronze and is constructed hollow approximately up to the coupling place with the stroke drive means.

12. An arrangement according to claim 7, wherein the gap between the valve body means and the stem means forms an insulative gap for preventing a heat conducting contact between the valve body means and the stem means whereby the cryogenic fuel is fed to the combustion space of the internal combustion engine with essentially unchange density.

13. An arrangement according to claim 12, wherein cryogenic fuel in the gap is rapidly renewed by a suction effect exerted on fuel in the gap by fuel flowing from the reservoir chamber means during each injection.

14. An arrangement according to claim 13, wherein a volume of the gap is significantly less than volume of the fuel reservoir chamber means.

15. An arrangement for a metered feeding of a cryogenic fuel having a low thermal conductivity to a combustion space of an internal combustion engine comprising:

a valve body means having a discharge opening at its distal end arranged downstream of a valve seat;

a valve for engaging the valve seat to close the discharge opening and actuated by movement of a hollow stem means guided in the valve body means by guide means, the valve intermittently controlling the opening of the discharge opening by movement of the stem means away from the discharge opening;

a fuel reservoir chamber means for storing cryogenic fuel to be fed to the combustion space, formed in the hollow stem means, which is connected by channel means arranged in the stem means with an overflow chamber upstream and adjacent the valve seat;

a fuel conducting connection which communicates with an inflow chamber adjacent a proximal end of the valve body means;

at least one radial opening in the hollow stem means adjacent the inflow chamber of the fuel conducting connection for conducting fuel to the fuel reservoir chamber of the stem means;

the valve body means and stem means being sized to form an insulative gap for interrupting heat flow to cryogenic fuel present in the fuel reservoir means of the hollow stem means and the valve means, the insulative gap extending, in a fuel conducting manner, between at least the inflow chamber and the overflow chamber and having a volume selected to be small as compared to a volume of the fuel reservoir chamber means, the insulative effect of the gap being promoted by cryogenic fuel in the gap;

whereby, during each injection of fuel to the combustion chamber, cryogenic fuel flowing from the reservoir chamber means by way of the channel means and the overflow chamber to the discharge opening exerts a suction effect on the cryogenic fuel present in the insulative gap to rapidly renew the cryogenic fuel in the gap, the volume of the cryogenic fuel conducted from the reservoir chamber means during each injection being significantly larger than the cryogenic fuel supplies from the insulative gap so that the cryogenic fuel is supplied to the combustion space with essentially unchanged density.

16. An arrangement according to claim 15, wherein the cryogenic fuel includes hydrogen.

* * * * *